US007779833B2

(12) United States Patent
Ginn

(10) Patent No.: US 7,779,833 B2
(45) Date of Patent: Aug. 24, 2010

(54) DIVING HELMET

(75) Inventor: Greg Ginn, New South Wales (AU)

(73) Assignee: Oceanwalker International Pty Ltd, San Souci, NSW (AU)

( * ) Notice: Subject to any disclaimer, the term of this patent is extended or adjusted under 35 U.S.C. 154(b) by 671 days.

(21) Appl. No.: 11/816,834

(22) PCT Filed: Feb. 23, 2005

(86) PCT No.: PCT/AU2005/000224

§ 371 (c)(1),
(2), (4) Date: Aug. 22, 2007

(87) PCT Pub. No.: WO2005/080193

PCT Pub. Date: Sep. 1, 2005

(65) Prior Publication Data

US 2009/0050147 A1 Feb. 26, 2009

(30) Foreign Application Priority Data

Feb. 23, 2004 (AU) ..... 2004900898

(51) Int. Cl.
*A61M 11/00* (2006.01)

(52) U.S. Cl. ..... 128/201.27; 128/201.29

(58) Field of Classification Search .....
128/201.27–201.29, 201.23, 200.29; 2/2.15, 2/410, 417
See application file for complete search history.

(56) References Cited

U.S. PATENT DOCUMENTS

| | | | | |
|---|---|---|---|---|
| 1,264,706 | A * | 4/1918 | Stallworth | 128/201.24 |
| 3,675,650 | A * | 7/1972 | Domyan et al. | 128/201.27 |
| 3,707,004 | A * | 12/1972 | Kapitan et al. | 2/2.5 |
| 3,880,157 | A | 4/1975 | Elifritz | |
| 5,219,368 | A * | 6/1993 | Page | 2/413 |

FOREIGN PATENT DOCUMENTS

| | | | |
|---|---|---|---|
| AU | 2002100749 | A4 | 11/2002 |
| AU | 2003100050 | B4 | 3/2003 |
| GB | 19127753 | A | 1/1913 |

* cited by examiner

*Primary Examiner*—Steven O Douglas
(74) *Attorney, Agent, or Firm*—Woodard, Emhardt, Moriarty, McNett & Henry LLP

(57) ABSTRACT

A diving helmet (10) of the type having an air supply pumped to it during use. The helmet (10) including a head portion (12) substantially formed from a transparent material such that a user can see both forwardly and rearwardly. The helmet (10) further including a body contacting collar portion (18) extending from the head portion (12). The collar portion having a shoulder engaging portion (24) adapted to prevent said helmet (10) from tipping during use.

10 Claims, 5 Drawing Sheets

DIVING HELMET

CROSS REFERENCE TO RELATED APPLICATION

This application is a National Stage filing of International Application PCT/AU2005/000224, filed Feb. 23, 2005, entitled "TRANSPARENT DIVING HELMET". The present application claims priority to PCT/AU2005/000224, and is expressly incorporated by reference herein, in its entirety.

FIELD OF THE INVENTION

The present invention relates to a diving helmet, and in particular to a diving helmet of the type that has a constant supply of breathable air pumped to it during use.

BACKGROUND OF THE INVENTION

Any discussion of the prior art throughout the specification should in no way be considered as an admission that such prior art is widely known or forms part of common general knowledge in the field.

It is known for divers to use a goggle and snorkel arrangement for underwater exploring. Typically the diver periodically rises to the surface of the water and takes large breadth before returning to continue his/her exploration.

Alternatively, if a diver does not wish to periodically rise to the surface to breathe, a body mounted air storage tank may be employed with breathable air supplied to the diver via a mouthpiece. This arrangement requires at least some level of prior training and is typical of divers who which to explore lower depths and therefore not very practical for beginner divers, who only wish to explore the shallows.

Another method of diving has been employed over recent years. This method involves the utilisation of a diving helmet that has breathable air continually supplied to it from a remote air supply. The helmet is open ended such that it resembles an inverted dome when submerged with a transparent face on the front side, which allows the diver to see outwardly.

An air supply connection in the helmet provides access to breathable air, which is supplied via a hose from said remote air supply unit. Typically, the helmet rests on a diver's shoulders with the excess air being expelled via gaps formed between the lower periphery of the helmet and the body of the diver.

Diving helmets such as these are becoming exceedingly popular for novice divers who wish to get under the water quickly with minimal training, and thereby ideally suited to the tourist industry.

One problem with diving helmets of this type is the amount of buoyant force that is produced by having such a large amount of air contained within the submerged enclosed volume. Typically, this problem is overcome by the attachment of lead weights. Unfortunately this leads to the helmet being so heavy out of the water that it requires at least two people to transport.

Another problem associated with these type of diving helmets is that there is a tendency for this type of helmet to move around once they are placed onto a diver's shoulders. Often this results in the helmet tipping forward or backward during use because it is not located sufficiently enough in position over the head of the diver.

Yet another problem with diving helmets of this configuration is the unavailability of any rearward vision by the diver. This is because such helmets are only designed for forward vision, having only a transparent front viewing visor.

Yet a further problem with diving helmets of this configuration is the high cost of manufacture. Typically helmets of this type are moulded from a plastic material and since the shape required is typically complex, multiple moulds and moulding operations are required.

It is therefore an object of the present invention in its preferred form to provide a diving helmet of the type that has breathable air constantly supplied to it that overcomes or ameliorates at least one of the disadvantages of the prior art, or at least provides a useful alternative.

BRIEF SUMMARY

According to a first aspect of the invention there is provided a diving helmet of the type having an air supply pumped to it during use, said helmet including:

- a head portion substantially formed from a transparent material such that a user can see both forwardly and rearwardly; and
- a body contacting collar portion extending from the head portion, said collar portion having a shoulder engaging portion adapted to prevent said helmet from tipping during use.

Preferably, the shoulder engaging portion comprises an inverted U-shaped section substantially extending along a first axis of the collar portion, the U-shaped section adapted to engage the shoulders of a user thereby positively locating the helmet during use.

Preferably, the first axis is coincident with the centre of the collar portion.

Preferably, infill pads are placed within the U-shaped section to ideally size the helmet for the user.

According to a another aspect of the invention, there is provided a diving helmet of the type having an air supply pumped to it during use, said helmet including:

- a head portion substantially formed from a transparent material which allows a user to see both forwardly and rearwardly; and
- a body contacting collar portion extending from the head portion, wherein said collar portion has at least one open ended cavity disposed therein, said cavity adapted to fill with water once said helmet is submerged thereby to reduce the buoyant force acting on the helmet.

Preferably, the cavity is adapted to fill with water via at least two apertures disposed in the outer periphery of the collar portion.

According to yet another aspect of the invention, there is provided a diving helmet of the type having an air supply pumped to it during use, the helmet including:

- a head portion substantially formed from a transparent material which allows a user to see both forwardly and rearwardly; and
- a body contacting collar portion extending from the head portion; wherein the head portion is substantially made from two identically moulded half faces, and wherein the body contacting collar portion is substantially made from two identically moulded half collars.

Preferably, the half faces are joined using removable fasteners.

Preferably, the half collars are joined using removable fasteners.

Preferably, a fastening means is used to join the half faces to the half collars.

Preferably, at least one spacer plate and at least one gasket member separate the half faces, and wherein the spacer plate and the gasket member separate the half collars.

Preferably, the helmet further includes an air flow port located at the top rear of the head portion, the port adapted to be connected to the air supply thereby providing breathing air to the user.

Preferably, the helmet further includes two opposed lifting handles, the handles disposed between the head portion and the collar portion.

Preferably, the opposed lifting handles are affixed to the spacer plate.

Preferably, the helmet is substantially formed from an injected moulded plastic.

According to yet another aspect of the invention there is provided, a diving helmet of the type having an air supply pumped to it during use, the helmet having a head portion adapted to fit the head of a user, wherein the head portion is formed from two substantially identically moulded halves.

BRIEF DESCRIPTION OF THE SEVERAL VIEWS OF THE DRAWINGS

A preferred embodiment of the invention will now be described, by way of example only, with reference to the accompanying drawings in which.

DETAILED DESCRIPTION

Figure 1:
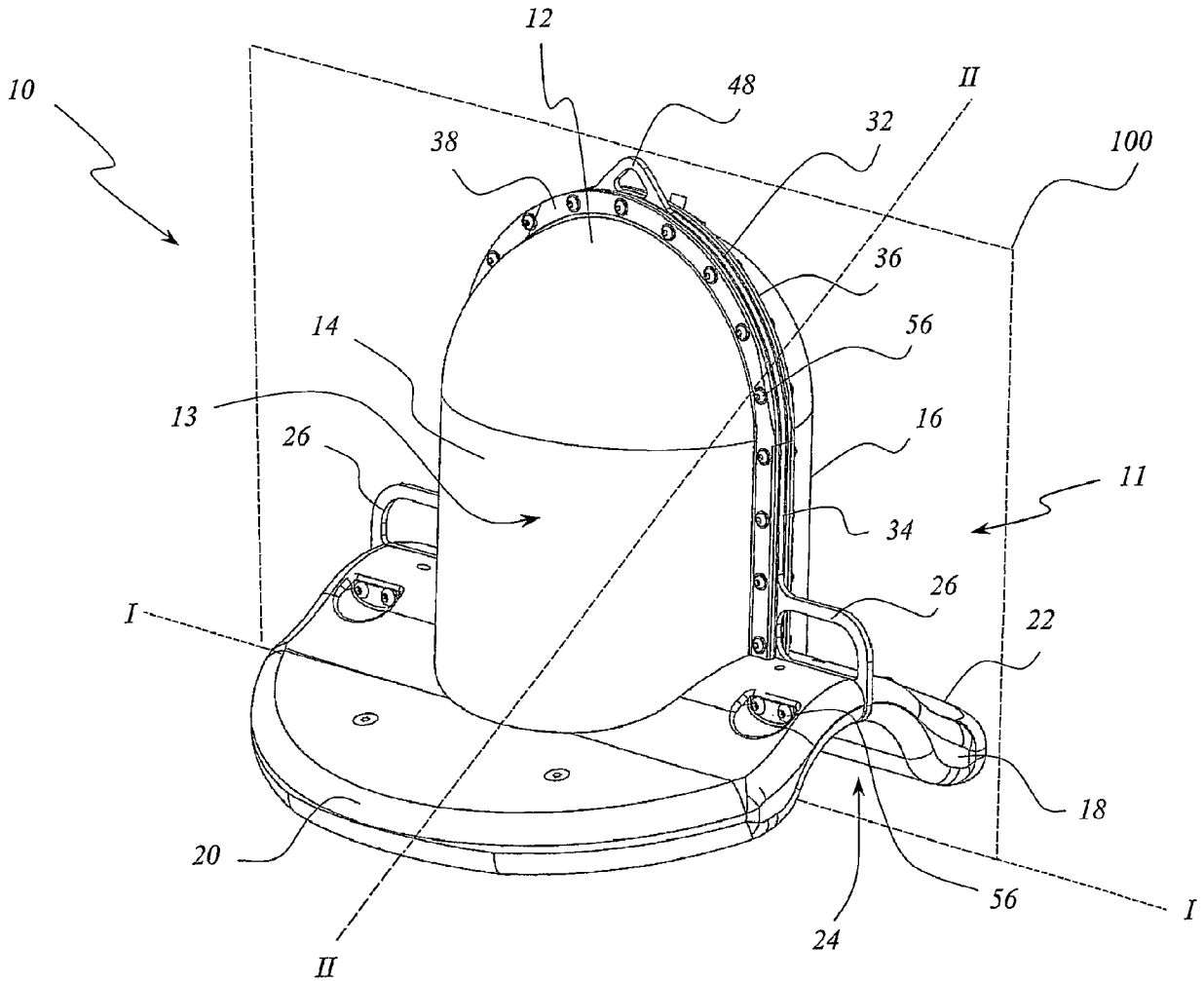
FIG. 1 is a front perspective view of a diving helmet according to a preferred embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

FIGS. 1 to 5 show diving helmet 10 according to a preferred embodiment of the present invention. Helmet 10 comprises a head portion 12 and a collar portion 18, with the head and collar portions each being formed by the assembly of substantially identical moulded parts joined along join plane 100. Helmet 10 therefore comprises a front section 11, which includes front face 14 and front collar 20, and a rear section 13, which includes rear face 16 and rear collar 22. Typically each face is joined to its respective collar using rivets, although any semi permanent fastening means may be used.

Advantageously, forming helmet 10 from two substantially identical moulded parts 11,13 saves significantly on manufacturing costs. This is due to only one set of moulding dies being required to make both parts. One moulding die is used to mould the front and rear faces and one moulding die is used to mould the front and rear collars. Prior art diving helmets in comparison, may require two or more sets of moulding dies to mould their helmets.

Figure 5:
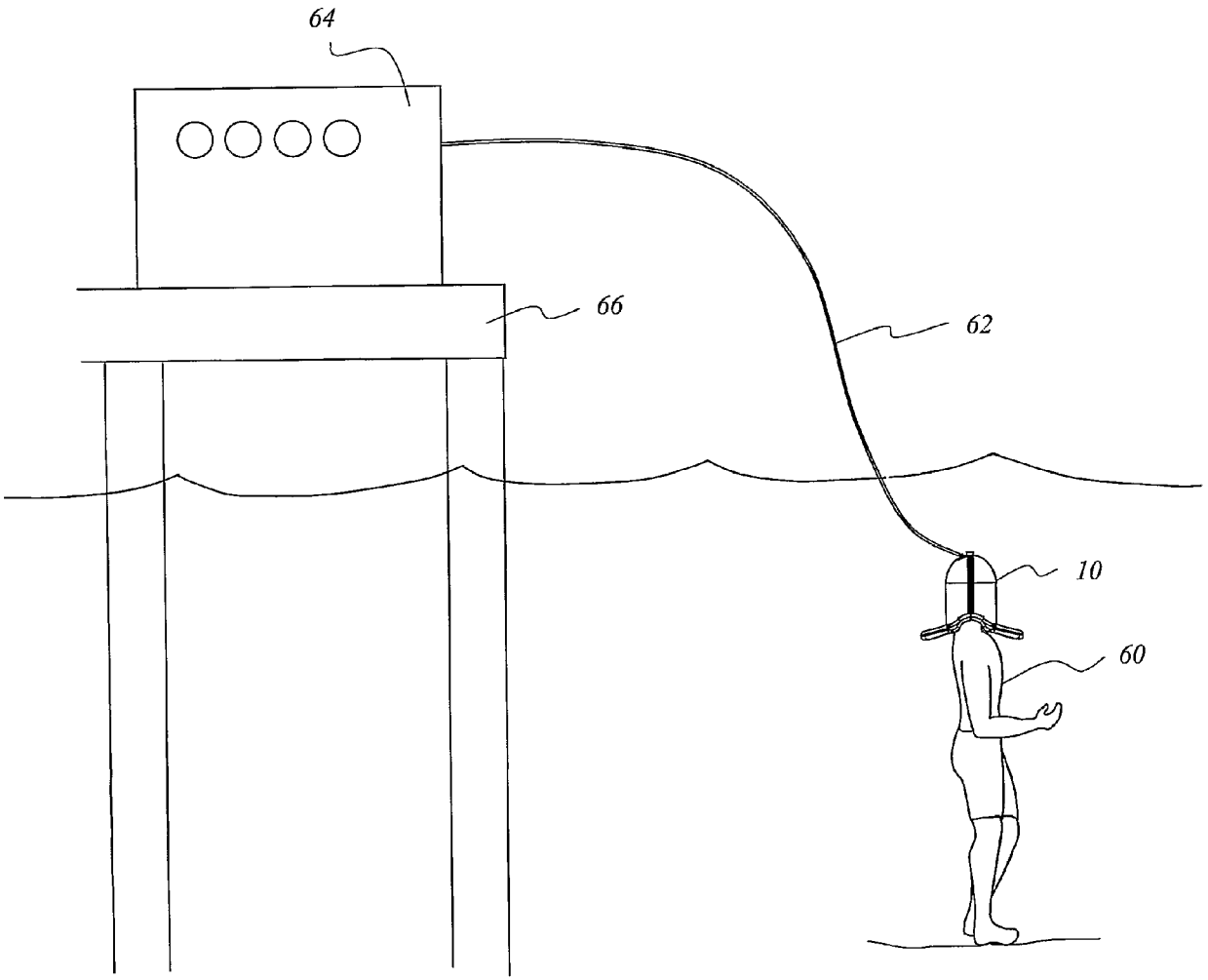
FIG. 5 is a view of the diving helmet of FIG. 1 shown in use.

Diving helmet 10 is of the type that has breathing air constantly pumped to it during use. FIG. 5 shows how diving helmet 10 is used in practice. Typically, diving helmet 10 is placed over the head of a diver 60 who is submerged in a body of water. Breathable air is constantly pumped to helmet 10 via supply hose 62 from an air supply generator 64. The pressure of the air within helmet 10 keeps the water out and allows the diver 60 to breathe. If the orientation of helmet 10 is reversed such that it fills with water, it simply needs to be corrected and the pressure of the airflow from air supply generator 64 will displace the water within. In this way, diving helmet 10 is advantageously safe to use by inexperienced divers and, for example, allows them to easily walk on the seabed.

Air supply generator 64 is located on platform 66, which may or may not be permanently anchored. Supply hose 62 is connected to helmet 10 via air connector assembly 44, which is shown in more detail on FIGS. 2 and 4.

Figure 2:
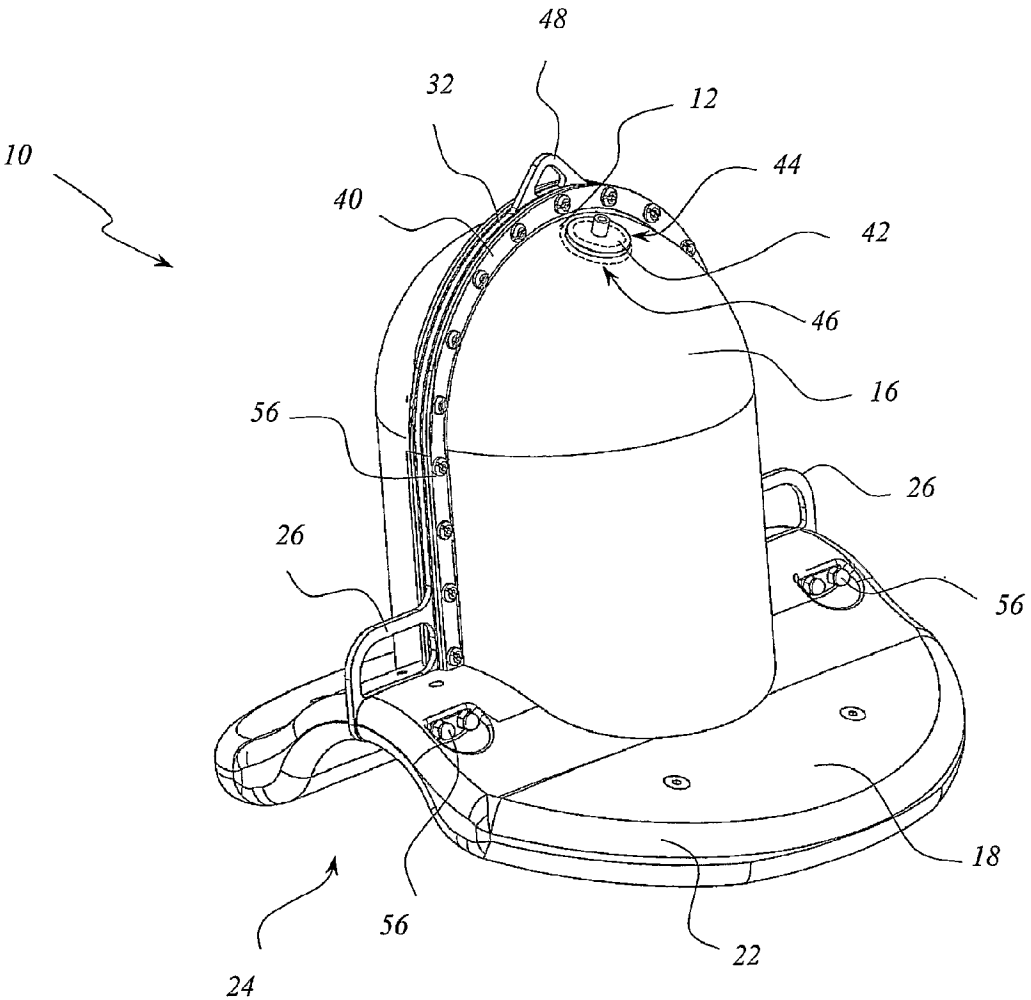
FIG. 2 is a rear perspective view of the diving helmet shown in FIG. 1.
Figure 3:
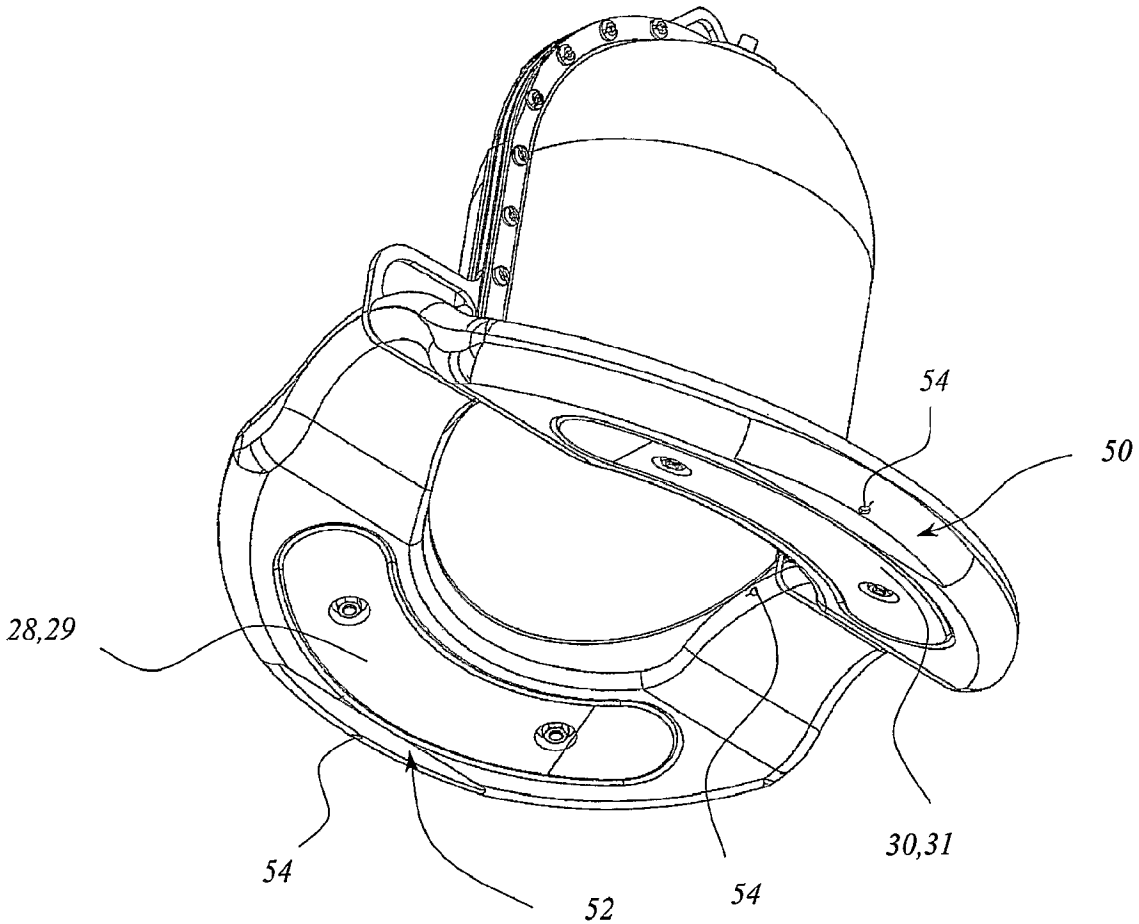
FIG. 3 is an underside perspective view of the diving helmet shown in FIG. 1.

Referring now to FIGS. 1 to 3 both the front and rear halves 14,16 of the head portion 12 are moulded from a transparent material. This allows the diver to have an almost uninterrupted field of view. Also, this extra viewing range makes the diving helmet 10 more comfortable and desirable to use as it almost makes the wearing totally unobtrusive. This is a significant improvement over the prior art diving helmets, which do not provide such an extent of view. Also, having the rear face 14 transparent assists other divers or instructors to monitor the physical condition of the diver from behind.

The requirement of air connector assembly 44 represents the main structural difference between the two moulded faces 14,16 in that, after moulding is complete a hole 42 must be placed in rear face 16. But since front face 14 is identical to rear face 16, the hole 42 only needs to be placed in half of the moulded parts during manufacture. The manufacturer is therefore unconcerned with differentiating between front and rear faces 14,16, which advantageously represents a further cost saving.

Figure 4:
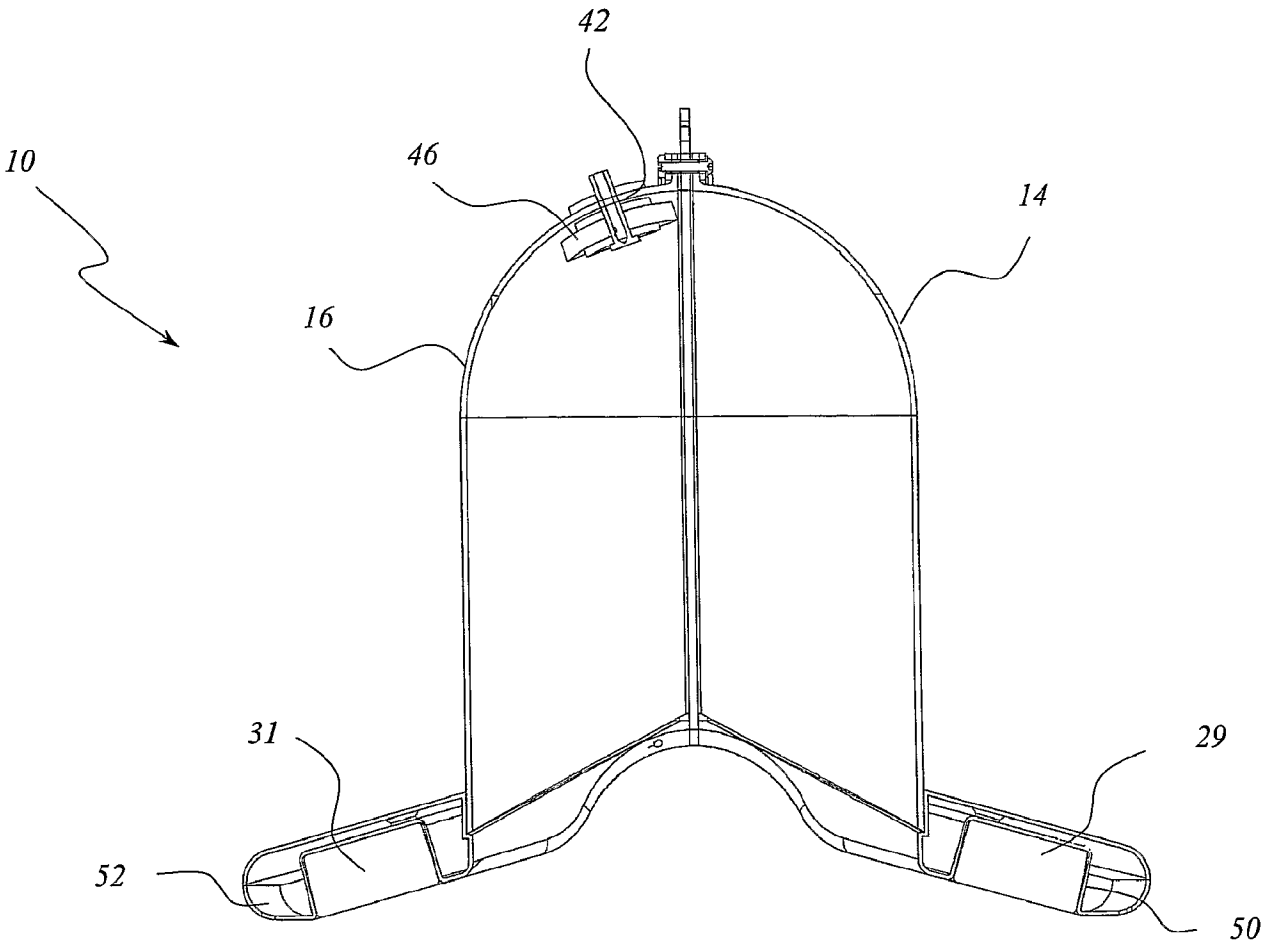
FIG. 4 is a side sectional view of the diving helmet shown in FIG. 1 through II-II.

Referring to FIG. 4, which is a sectional view through axis II-II of FIG. 1, we can clearly see a more detailed view of the air connector assembly 44. In this preferred embodiment, item 46 acts as both a filter and diffuser, but in other not shown embodiments, two separate items may be utilised to perform the same function.

The air connector assembly 44 is advantageously located in the top section of the rear face 16. This location allows the air to enter the diving helmet 10 above the rear of the diver's head. This is so that the air entry is unobtrusive to the diver and also diffuser 46 gives a desirable quiet air supply.

As mentioned earlier, diving helmet 10 is assembled from two substantially identical moulded parts 11,13 each of which has a face and a collar. Moulded parts 11,13 are joined along a join plane 100, which is coincident with the centre of spacer plate 32. Spacer plate 32 provides a separation between moulded parts 11,13 as well functioning as a uniform sealing surface for both front and rear gasket seals 34,36. Also, the spacer plate 32 provides anchor points for opposed lifting handles 26 and lifting aperture 48.

In this preferred embodiment items 32-36 are integrally formed with spacer plate 32 alternatively, items 32-36 may be affixed to diving helmet 10 using some fastening means.

Front and rear support plates 38, 40 provide surfaces for screw fasteners 56 to abut against such that the moulded parts 11,13 are positively joined.

Collar portion 18 is moulded such that it accommodates the shoulders of the diver by providing a shoulder engaging portion 24. Shoulder engaging portion 24 is shaped to resemble an inverted U and extends along axis 1-1, which is coincident with join plane 100. It is provided to more positively secure diving helmet 10 to the body of the diver. It also stops diving helmet 10 from tipping forward and backward during use, which is a common problem with prior art diving helmets.

Infill pads (not shown) may also be placed inside the shoulder engaging portion 24, such that all size divers may be ideally accommodated.

The volume of air contained within the head portion 12 of diving helmet 10 plus the volume of the water displaced by the collar portion 18 creates a significant buoyant force. This buoyant force has to be overcome if the diving helmet 10 is to be easily manipulated once submerged. This is a common problem with prior art diving helmets of this type and it is well known by persons skilled in the art to affix lead weights somehow so as to counteract this force. As a result, diving helmets of this type are typically very heavy out of the water and usually require two people or even special lifting devices to carry.

Diving helmet 10 reduces the buoyant force due to volume displaced by the collar portion 18, by providing cavities 52,50 within the collar portion 18. FIG. 4 clearly shows these cavities 50,52 in section. Cavities 50,52 fill with water once diving helmet 10 is submerged utilising drain holes 54, which are positioned around the collar portion's 18 lower periphery to allow water to freely enter and leave cavities 50,52. Once cavities 50,52 begin to fill with water, the buoyant force will begin to reduce.

The provision of cavities 52,50 allows for less weighting to be attached to diving helmet 10 then in the prior art diving helmets without any loss of structural integrity. In turn, this translates to the diving helmet 10 being lighter and easier to move around when not submerged, since cavities 50,52 are empty.

Although the buoyant force has been reduced it is still substantial and therefore needs to be overcome by adding a counteracting load to diving helmet 10. FIG. 3 shows lead weights 28, 30 flush mounted to the lower periphery of collar portion 18 and within recesses 29,31. Providing recesses 29,31 (FIGS. 3 and 4) further acts to reduce the buoyant force on the collar portion 18 by not allowing the lead weights 28, 30 to create any extra volume.

In comparison to the prior art, the combination of all the above-mentioned features allows for diving helmet 10 to be easier to manipulate above water, safer to use, be more diver comfortable and desirable, be cheaper to manufacture and have a greater viewing range.

Although the invention has been described with reference to a specific example, it will be appreciated by those skilled in the art that the invention can be embodied in many other forms.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A diving helmet comprising:

a head portion including a first molded front portion adapted to be located in front of a users face and a second substantially identically molded rear portion, said front portion and said rear portion being formed from a transparent material and said front portion and said rear portion are connected together to define a chamber for receiving a users head;

an air inlet port located in one of said front portion and said rear portion; and a collar extending from the head portion, an underside of said collar forming a shoulder engagement portion.

2. The diving helmet of claim 1, wherein said front portion and said rear portion are connected along a join plane with removable fasteners.

3. The diving helmet of claim 2, wherein said collar includes two substantially identical molded half collars, and the half collars are located on either side of said plane and connected with removable fasteners.

4. The diving helmet of claim 3, wherein a gasket and a spacer plate extend along said plane such that said gasket and said spacer plate separate said front portion and said rear portion, said gasket and said spacer plate also separate said half collars.

5. The diving helmet of claim 4 including two opposed lifting handles, said handles being located between said head portion and said collar.

6. The diving helmet of claim 5, wherein said half collars are connected to said spacer plate.

7. The diving helmet of claim 6, wherein said front portion and said rear portion are formed from injection molded plastic.

8. The diving helmet of claim 1, wherein said shoulder engagement portion has an inverted U-shaped section.

9. The diving helmet of claim 1 including two opposed lifting handles, said handles being located between said head portion and said collar.

10. The diving helmet of claim 1, wherein said front portion and said rear portion are formed from injection molded plastic.

* * * * *